US009163295B2

(12) United States Patent
Yamamoto

(10) Patent No.: US 9,163,295 B2
(45) **Date of Patent: *Oct. 20, 2015**

(54) SHOT-TREATMENT APPARATUS

(75) Inventor: Masatoshi Yamamoto, Toyokawa (JP)

(73) Assignee: SINTOKOGIO, LTD., Nagoya-shi (JP)

( * ) Notice: Subject to any disclaimer, the term of this patent is extended or adjusted under 35 U.S.C. 154(b) by 225 days.

This patent is subject to a terminal disclaimer.

(21) Appl. No.: 13/822,958

(22) PCT Filed: Jul. 25, 2011

(86) PCT No.: PCT/JP2011/004168

§ 371 (c)(1),
(2), (4) Date: Mar. 13, 2013

(87) PCT Pub. No.: WO2012/063383

PCT Pub. Date: May 18, 2012

(65) Prior Publication Data

US 2013/0213104 A1 Aug. 22, 2013

(30) Foreign Application Priority Data

Nov. 9, 2010 (JP) ..... 2010-250784

(51) Int. Cl.

| | |
|---|---|
| ***B24C 3/10*** | (2006.01) |
| ***C21D 7/06*** | (2006.01) |
| ***B24C 3/20*** | (2006.01) |
| ***B24C 3/08*** | (2006.01) |
| ***B24C 1/10*** | (2006.01) |
| ***B24C 3/22*** | (2006.01) |

(52) U.S. Cl.

CPC ... *C21D 7/06* (2013.01); *B24C 1/10* (2013.01); *B24C 3/085* (2013.01); *B24C 3/20* (2013.01); *B24C 3/22* (2013.01)

(58) Field of Classification Search

CPC ..... B24C 1/10; B24C 3/085; B24C 3/086; B24C 3/12; B24C 3/18; B24C 3/20; B24C 3/22; C21D 7/06; B21D 31/06

USPC ..... 72/53; 451/82, 84, 114, 398, 400, 403, 451/413

See application file for complete search history.

(56) References Cited

U.S. PATENT DOCUMENTS 2,276,345 A * 3/1942 Rosenberger ..... 451/87
3,146,550 A 9/1964 Millhiser et al.

(Continued)

FOREIGN PATENT DOCUMENTS

DE 38 24 949 A1 1/1990
JP 01271175 A * 10/1989 ..... B24C 5/06
JP 2002-096264 4/2002

OTHER PUBLICATIONS

English-language International Search Report from the European Patent Office for International Application No. PCT/JP2011/004168, mailing date Nov. 30, 2011.

*Primary Examiner* — Peter DungBa Vo
*Assistant Examiner* — Joshua D Anderson
(74) *Attorney, Agent, or Firm* — Finnegan, Henderson, Farabow, Garrett & Dunner, L.L.P.

(57) ABSTRACT

The present invention aims to provide a shot-treatment apparatus which allows a high throughput of workpieces with the least possible idle time while achieving a uniform shot-treatment effect on workpieces. The shot-treatment apparatus of the present invention has a rotatable main table 30 located in the place where both a projection area to be projected upon by the shot from a projecting device and a non-projection area are included. A plurality of satellite tables 32 for placing workpieces 12 are rotatably mounted on the main table 30. Each satellite table 32 has a driven shaft 33 which is in parallel with a main shaft 31 of the main table 30. The shot is projected from the projecting device against the workpiece 12 that is placed on the satellite table 32. The workpiece 12 that is placed on the satellite table 32 is held down by a holding member 48 of a holding assembly 46. The holding member 48 rotates along with the workpiece 12.

8 Claims, 11 Drawing Sheets

(56) References Cited

U.S. PATENT DOCUMENTS 5,029,419 A * 7/1991 Nakayama et al. ..... 451/53
5,272,897 A * 12/1993 Wern ..... 72/53
2013/0327105 A1* 12/2013 Yamamoto ..... 72/53
2014/0360241 A1* 12/2014 Yamamoto ..... 72/53

* cited by examiner (A)

(B)

SHOT-TREATMENT APPARATUS

TECHNICAL FIELD

This invention relates to a shot-treatment apparatus for projecting shot (metallic, glass, or ceramic particles) against a workpiece.

BACKGROUND OF THE INVENTION

There is a type of shot-treatment machine which comprises a table being rotatable in a substantially horizontal plane, and a plurality of workpiece-stages fixed to the table (e.g., see Patent Document 1). Items (i.e., workpieces) placed on the workpiece-stages are blasted when the table is rotating.

CITATION LIST

Patent Literature

Patent Document 1;
Japanese Patent Laid-open Publication No. 2002-96264

SUMMARY OF INVENTION

Technical Problem

However, in this type of prior art machine, a blasting operation needs to be suspended during the loading and unloading operations of the items. Thus, the utilization rate of the machine is not high due to the idle time caused by the loading and unloading operations.

The present invention aims to provide a shot-treatment apparatus which allows a high throughput of workpieces with the least possible idle time while achieving a uniform shot-treatment effect on workpieces.

Solution to Problem

The shot-treatment apparatus of the present invention comprises the following Features: a projecting device for projecting shot with compressed air through a nozzle against a workpiece; a rotatable main table located in a place where both a projection area to be projected by the shot from the projecting device and a non-projection area which is the area other than the projection area are included; a plurality of rotatable satellite tables mounted on the main table, wherein each of the satellite tables for placing workpieces has a driven shaft in parallel with a main shaft of the main table; a holding assembly disposed above the projection area of the main table, wherein the holding assembly holds down the workpiece placed on the satellite table with a holding member which is configured to be rotatable along with the workpiece. Preferably, the satellite tables are arranged in a circle around the main shaft of the main table. When the main table is rotated, one or more satellite tables are positioned in the projection area. Preferably, the holding member holds down the workpiece when at least one satellite table is positioned in the projection area. Further, the holding member rotates about the rotational axis of the satellite table along with the satellite table.

The shot-treatment apparatus of the present invention has the rotatable main table located in the place where both the projection area to be projected upon by the shot from the projecting device and the non-projection area which is the area other than the projecting area are included. A plurality of satellite tables for placing workpieces are rotatably mounted on the main table. Each satellite table has a driven shaft which is in parallel with the main shaft of the main table. The shot is projected through the nozzle of the projecting device against the workpiece with compressed air.

The holding assembly is disposed above the projection area of the main table. The holding member, which is included in the holding assembly, holds down the workpiece placed on the satellite table. The holding member is configured to be rotatable along with the workpiece. By this, the workpiece is secured on the satellite table when it is subjected to a shot-treatment. Further, even when one or more workpieces are subjected to the shot-treatment, other workpieces sitting in the non-projection area can be loaded to and unloaded from the satellite table.

In some embodiments, the shot-treatment apparatus has a rotation-sensing means for detecting the rotation of the holding member.

In this embodiment, when the holding member is rotating along with the workpiece, the rotation-sensing means detects the rotation of the holding member. Accordingly, the apparatus can judge whether a uniform shot-treatment effect on the workpieces is achieved, by detecting the state of the rotation of the workpieces.

In another embodiment, the shot-treatment apparatus further comprises the following features: a driving assembly which rotates the main table about the main shaft in a stepwise manner by a specific angle which is predetermined based on the arrangement of the satellite tables on the main table, so that at least one satellite table is positioned within the projection area when the rotation of the main table is suspended; and a controlling unit which suspends the projection of the shot from the projecting device while the main table is being rotated by the dividing assembly, and resumes the projection of the shot when the rotation of the main table is suspended. Preferably, the control unit lowers the holding member to secure the workpiece on the satellite table before starting the projection of shot. Further, the control unit raises the holding member and suspends the projection of shot before starting the rotation of the main table.

In such an embodiment, the dividing assembly rotates the main table about the main shaft in a stepwise manner by a specific angle which is predetermined based on the arrangement of the satellite tables on the main table. When the rotation of the main table is suspended, at least one satellite table is positioned within the projection area. The controlling unit suspends the projection of the shot from the projecting device while the main table is being rotated by the dividing assembly. Further, the controlling unit resumes the projection of the shot when the rotation of the main table is suspended. By this, any leakage of shot from the apparatus is reduced, and a uniform shot-treatment effect on workpieces is achieved.

In some embodiments, the shot-treatment apparatus further comprises the following features: first mating members disposed on the individual driven shafts extending downward from each of the satellite tables; at least one second mating member located below the main table in the projection area, wherein the second mating member is engageable with any of the first mating members to transmit rotational driving force to the first mating member; and a meshing assembly for engaging the second mating member with the first mating member when the rotation of the main table is suspended, and for disengaging the second mating member from the first mating member before starting the rotation of the main table.

In such embodiments, the satellite table of the shot-treatment apparatus has the first mating member disposed on the driven shaft which is extending downward from the satellite table. The second mating member, which is disposed below the main table in the projection area, is capable of engaging with the first mating member. The meshing assembly engages the second mating member with the first mating member when the rotation of the main table is suspended. Further, the second mating member transmits a rotational driving force to the first mating member when the second mating member is engaged with the first mating member. The meshing assembly disengages the second mating member from the first mating member before starting the rotation of the main table. By this, when the rotation of the main table is suspended, the workpiece constantly rotates while being secured on the satellite table. As a result, a uniform shot-treatment effect on the entire surface of the workpiece is achieved. Further, the main table is allowed to rotate without interruption when the rotation of the table is resumed.

In some embodiments, the meshing assembly of the shot-treatment apparatus further comprises the following features: a rod member having the second mating member at one end thereof; and a cylinder mechanism for driving the rod member in the direction of disengaging the second mating member from the first mating member.

In such embodiments, the second mating member is disposed at one end of the rod member, and the cylinder mechanism drives the rod member in the direction of disengaging the second mating member from the first mating member. By this, the engagement and disengagement of the first and second mating members are conducted with a simple mechanism.

In some embodiments, the shot-treatment apparatus further comprises a driving motor disposed below the rod member for rotating the second mating member together with the rod member, wherein the rod member is rotated by the motor through a means for transmitting the driving force.

In such embodiments, the second mating member and the rod member are rotated by the driving motor disposed below the rod member through the means for transmitting the driving force from the motor to the rod member. By this, the size of the shot-treatment apparatus is reduced.

In another embodiment, the cylinder mechanism is disposed below the driving motor so that the axis of the cylinder mechanism is in parallel with the rotational axis of the motor.

In such an embodiment, the cylinder mechanism is located below the driving motor so that the axis of the cylinder mechanism is in parallel with the rotational axis of the motor. By this, the size of the shot-treatment apparatus is further reduced.

In some embodiments, the shot-treatment apparatus includes at least one first section and at least one second section alternately formed on the main table by a plurality of walls extending from the inside of the table to the circumference thereof, wherein the first section is provided with the satellite table, and the second section has no satellite table. Preferably, the first and second sections are formed on the main table no as to be rotationally symmetric about the main shaft.

In such embodiments, the shot-treatment apparatus includes at least one first section and at least one second section alternately formed on the main table by a plurality of partitions extending from the inside of the table to the circumference thereof, wherein the first section is provided with the satellite table, and the second section has no satellite table. By this, any leakage of the shot from the apparatus is effectively prevented.

Advantageous Effect of the Invention

As described above, the present invention provides a shot-treatment apparatus which allows a high throughput of workpieces with the least possible idle time while achieving a uniform shot-treatment effect on workpieces.

BRIEF DESCRIPTION OF DRAWINGS

FIG. 6A is a schematic sectional right side view taken through the cabinet of the shot peening apparatus. FIG. 6A is a schematic side view taken from the direction indicated by the arrow 6B as in FIG. 6A.

In FIG. 9A, a second mating member is engaged with a first mating member. In FIG. 9B, the second mating member is disengaged from the first mating member.

DESCRIPTION OF EMBODIMENTS

First Embodiment

The shot peening apparatus 10 according to the first embodiment of the invention is described below with reference to FIGS. 1-9. The figures are illustrated as if some outer panels of the cabinet of the apparatus have been removed (or out away). Exemplary workpieces 12 to be treated by the apparatus are mechanical parts, such as gears for an AT (automatic transmission).

Figure 1:
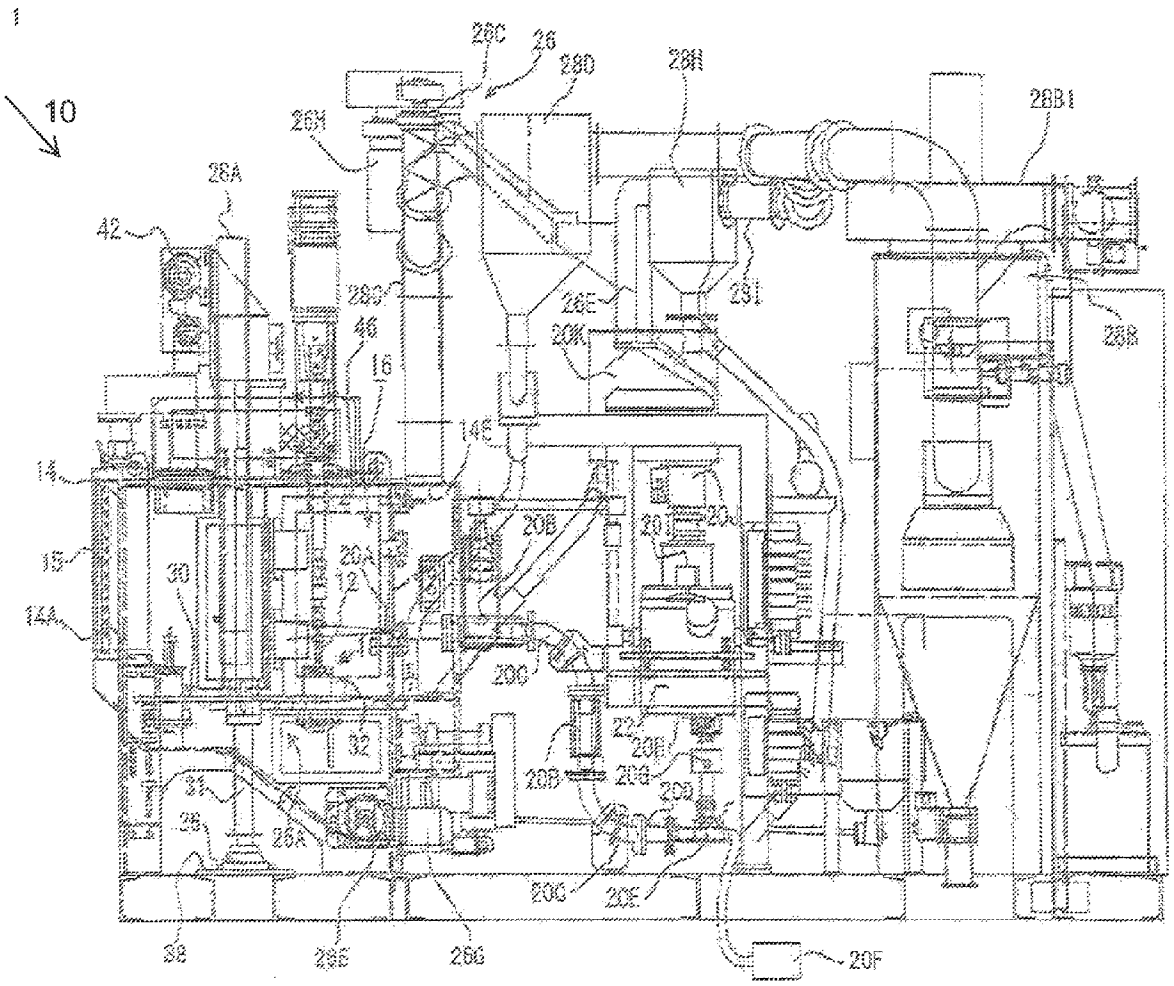
FIG. 1 is a right side elevation view of a shot peening apparatus according to a first embodiment of the invention.
Figure 2:
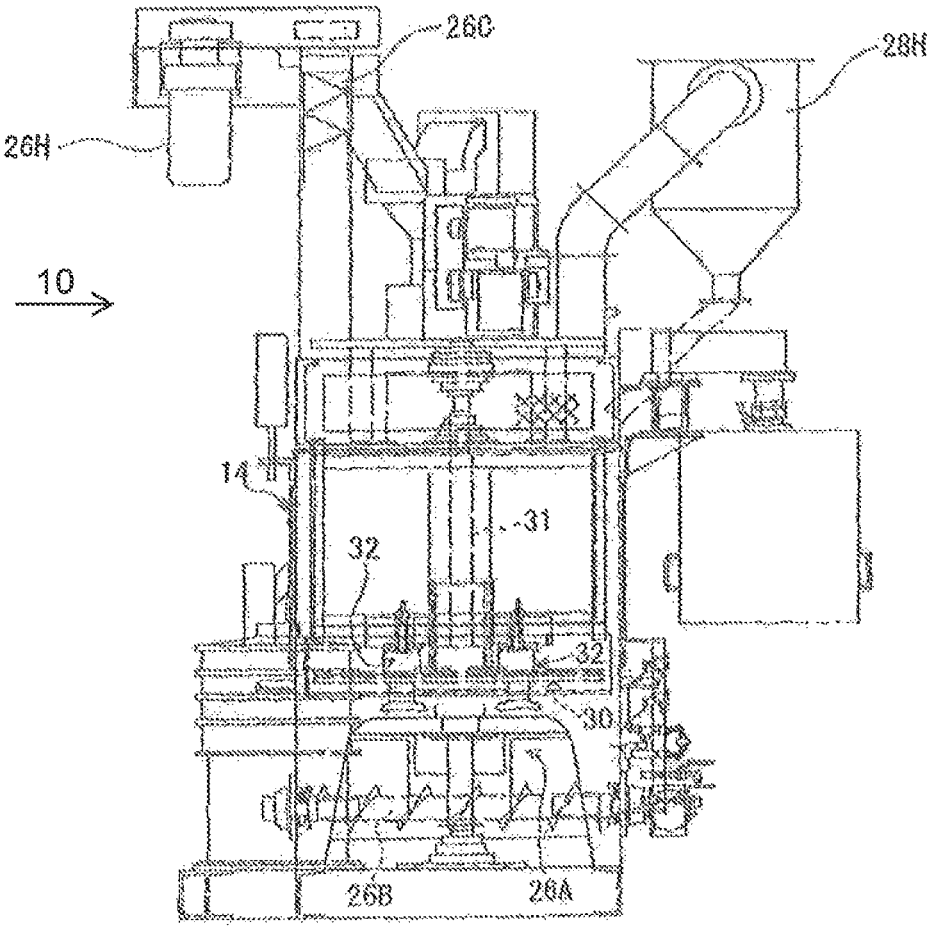
FIG. 2 is a front elevation view of the shot peening apparatus according to the first embodiment.
Figure 3:
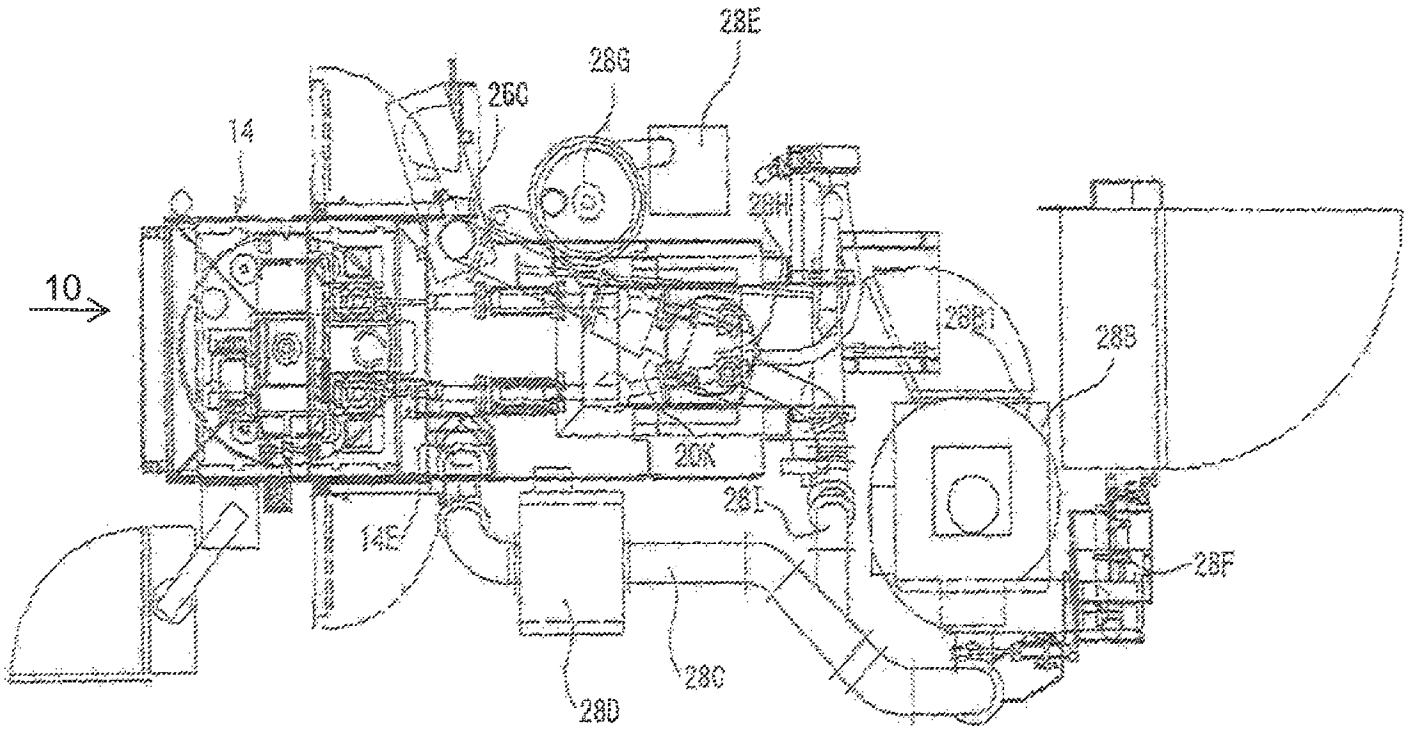
FIG. 3 is a plan view of the shot peening apparatus according to the first embodiment.

FIG. 1 shows a right side elevation of the shot peening apparatus 10. FIG. 2 shows a front elevation of the apparatus 10. FIG. 3 shows a plan view of the apparatus 10.

As in FIG. 1, the shot peening apparatus 10 has a cabinet 14. A shot-treatment chamber 16 is disposed in the interior of the cabinet 14, where shot is projected against the workpiece 12 for performing a surface treatment. The cabinet 14 also has a gateway 14A formed on the sidewall of the cabinet for transferring the workpiece 12 to and from the chamber 16. The gateway 14A is provided with an area sensor 15.

Figure 8:
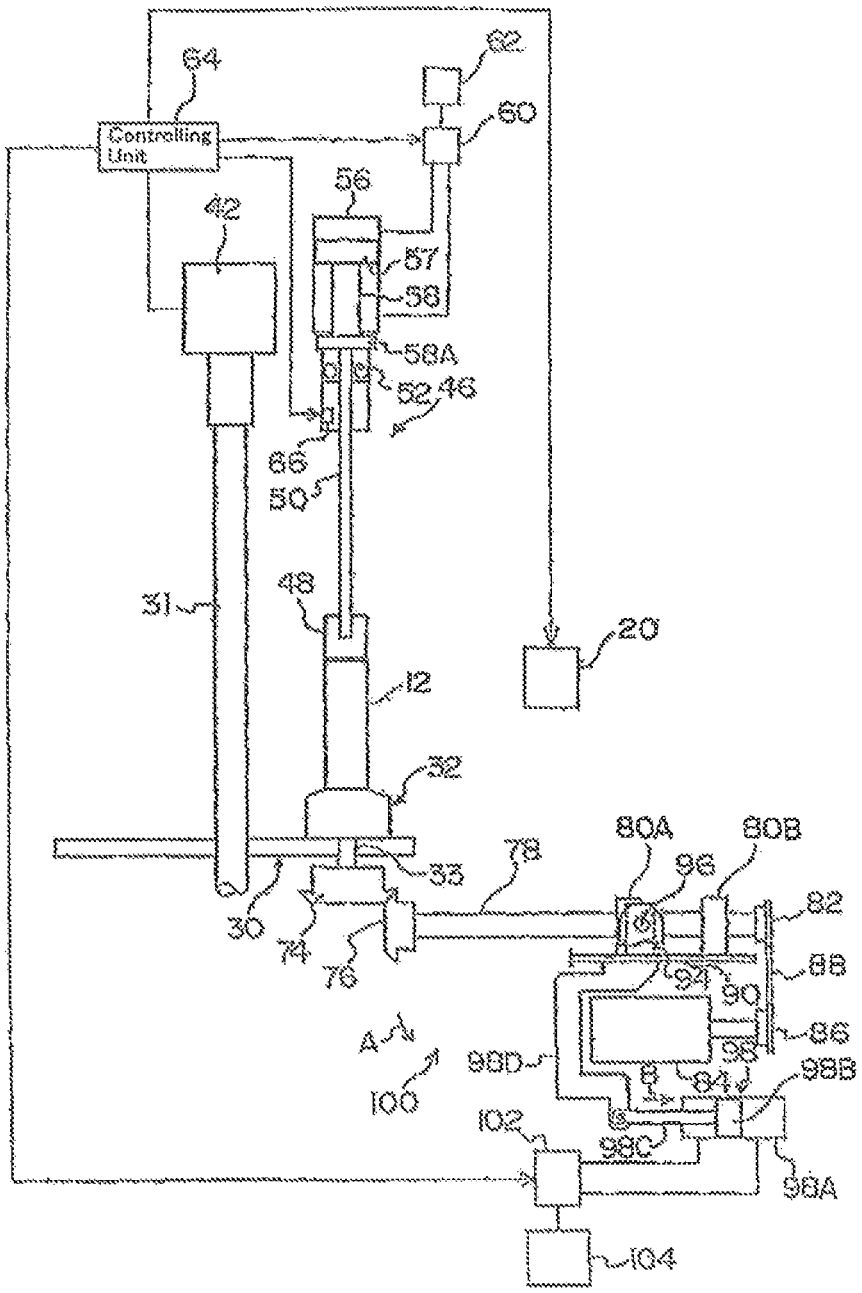
FIG. 8 is a schematic diagram to show a procedure for controlling the shot peening apparatus according to the first embodiment.
Figure 9:
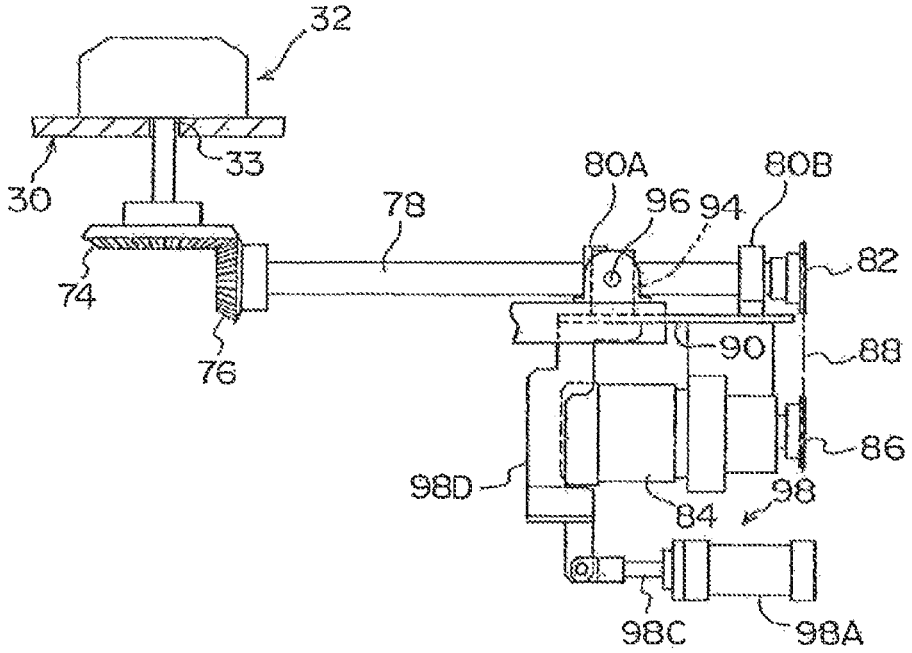
FIG. 9 is a schematic diagram to show the engaging/disengaging mechanism of the shot peening apparatus according to the first embodiment.
Figure 9:
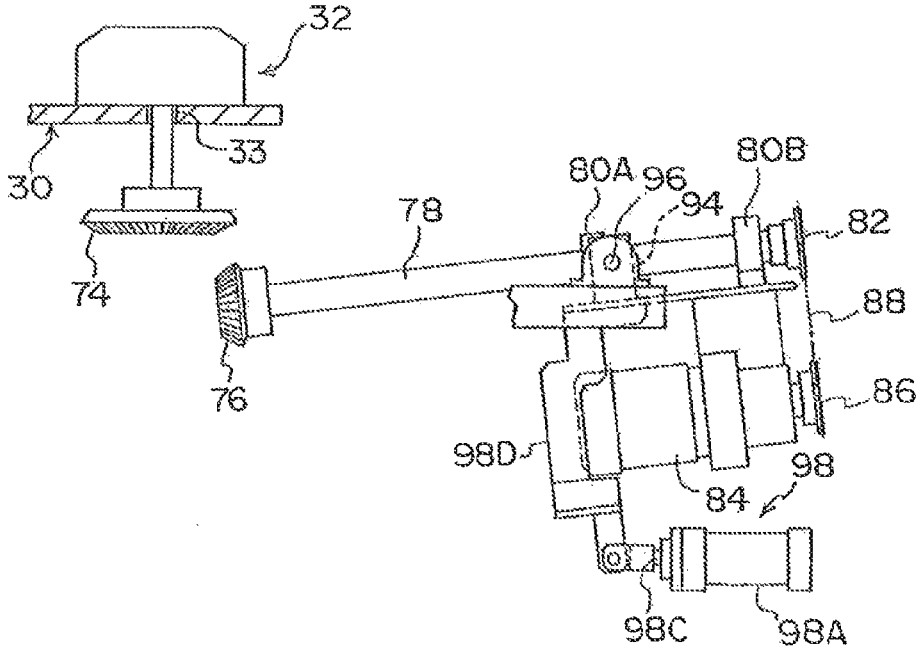

A work-table 18 for loading the workpieces 12 is disposed at the lower part of the interior of the cabinet 14. The work-table 18 will be discussed below in detail. A nozzle 20A of a projecting device 20 is disposed on the side wall of the cabinet 14. The projecting device 20 projects shot (i.e., particles, e.g., steel balls such as Round Cut Wire available from TOYO SEIKO K.K.) with compressed air through the nozzle 20A against the workpiece 12 placed in the shot-treatment chamber 16. As illustrated in FIG. 8, the projecting device 20 communicates with a controlling unit 64. The controlling unit 64 controls the projecting process of the projecting device 20. The projecting device 20 is described below.

As in FIG. 1, the nozzle 20A is connected to a mixing valve 20E though an abrasion-resistant hose 20B, a bent pipe 20C made of cast steel, and a steel pipe 20D. The mixing valve 20E is connected to an air source 20F (depicted as a unit in FIG. 1), and also connected to a pressure tank 22 through a flow regulator 20G and a cut-gate 20H. The shot supplied from the flow regulator 20G and compressed air supplied from the air source 20F are mixed in the mixing valve 20E. The pressure tank 22 is connected to a shot tank 20K via a constant feeder 20J and a poppet valve 20I disposed on the pressure tank 22. The shot tank 20K, which is located above the constant feeder 20J, is for feeding shot to the constant feeder 20J.

Figure 4:
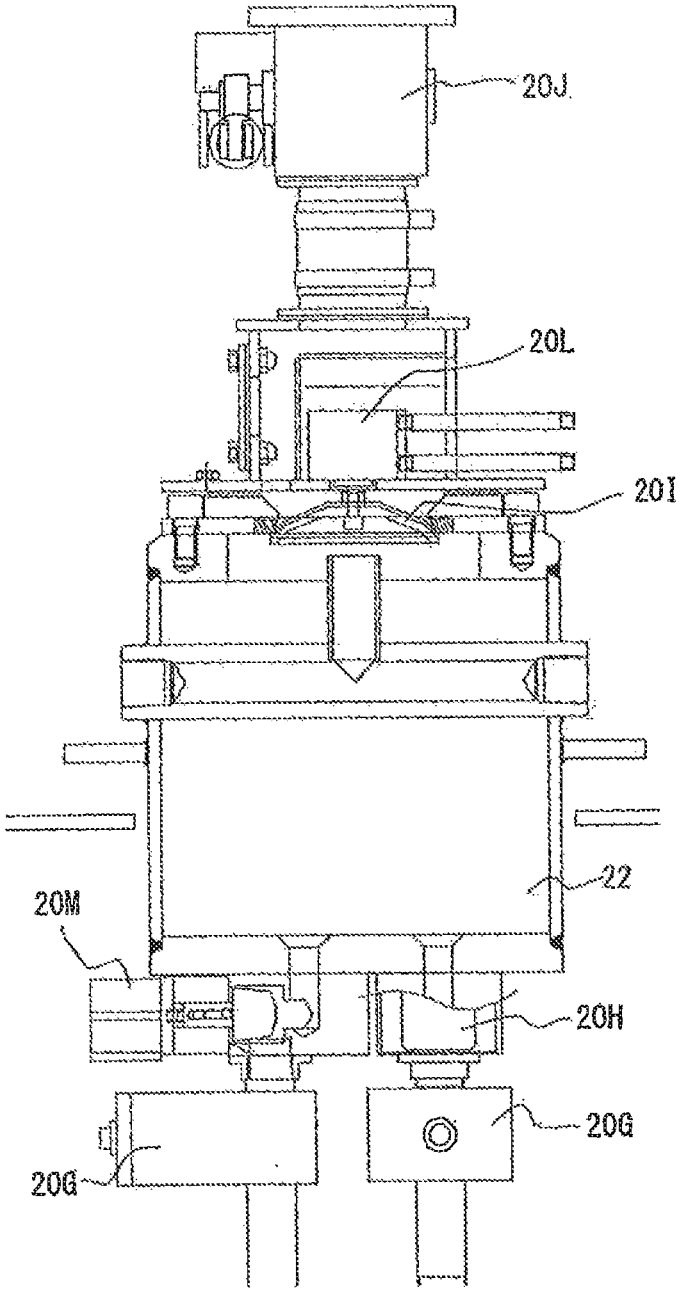
FIG. 4 is a partially enlarged view of the pressure tank of the shot peening apparatus and associated facilities thereof, according to the first embodiment.

FIG. 4 shows the pressure tank 22 and associated facilities thereof. The pressure tank 22 has a level meter (not shown) for detecting the amount of shot stored in the pressure tank 22. The level meter is electrically connected to the controlling unit 64 (see FIG. 8). When the level meter detects that the quantity of shot in the pressure tank 22 is lower than a desired quantity, the controlling unit 64 opens the poppet valve 20I. Namely, the controlling unit 64 (see FIG. 8) opens and closes the poppet valve 20I by actuating a driving cylinder 20L, which is for operating the poppet valve 20I, via the signal from the level meter. When the poppet valve 20I is opened, a desired quantity of shot is supplied to the pressure tank 22 from the shot tank 20K (see FIG. 1) through the constant feeder 20J.

The cut-gate 20H disposed below the pressure tank 22 is operated by a driving cylinder 20M. The controlling unit 64 (see FIG. 8) opens and closes the cut-gate 20H by actuating the driving cylinder 20M. For projecting shot from the projecting device 20, first the pressure tank 22 is filled up with the shot, and then the controlling unit 64 (see FIG. 8), closes the constant feeder 20J and the poppet valve 20I to pressurize the pressure tank 22. Next, the controlling unit 64 opens the cut-gate 20H and the flow regulator 20G while feeding compressed air to the mixing valve 20E. As a result, the shot flows from the pressure tank 22 to the mixing valve 20E through the cut-gate 20H and the flow regulator 20G. The shot is accelerated by the compressed air in the mixing valve 20E, conveyed through the steel pipe 20D, the bent pipe 20C, and the abrasion-resistant hose 20B, and then projected through the nozzle 20A against the workpiece. In this way, the shot peening treatment of the workpiece is accomplished.

The shot peening apparatus 10 further includes a recycling assembly 26 for sending hack the shot projected from the projecting device 20 to the shot tank 20K. The recycling assembly 26 includes a hopper 26A, which is disposed under the work-table 18, for recovering the shot in the cabinet 14. A screw conveyor 26B equipped with a driving motor 26G is disposed under the hopper 26A.

As in FIG. 2, the screw conveyor 26B, which is disposed in a horizontal direction, conveys shot flowing from the hopper 26A in a longer direction (the traverse direction in FIG. 2) of the screw conveyor 26B. At the downstream side of the screw conveyor 26B (at the left-hand side in FIG. 2), an inlet of an elevating screw conveyor 26C is located. The elevating screw conveyor 26C, which has a driving motor 26H at the upper end, conveys the shot fed to the inlet above the cabinet 14.

As illustrated in FIG. 1, a separator 26E is provided below the upper end of the screw conveyor 26C (at the lower right side of the upper end of the conveyor in FIG. 1). The shot conveyed to the upper end of the conveyor 26C is transferred to the separator 26E via a conduit. The separator 26E is connected to the shot tank 20K, and is capable of sending only adequate shot back to the shot tank 20K.

A ventilator 28A is disposed at the top of the cabinet 14. An exhaust port 14E of the cabinet 14 is connected to a duct 28C. Fine particles generated in the cabinet 14 are sucked out through the exhaust port 14E and the duct 28C. The duct 28C includes a settling chamber 28D for settling down the fine particles contained in the sucked air. The settling chamber 28D is connected to the inlet of the elevating screw conveyor 26C, so that the shot separated in the settling chamber 28D can be reused. As illustrated in FIG. 3, the duct 28C is connected to a dust collector 28B equipped with a fan 28B1. The dust collector 28B filters the fine particles contained in the air coming from the settling chamber 28D and the duct 28C, so that only air is discharged outside the apparatus.

As illustrated in FIG. 1, the duct 28C is connected to the separator 26E through the settling chamber 28H and a duct 28I. By this, the particles sucked out from the separator 26E are transferred to the dust collector 28B for filtration, via the settling chamber 28H and the ducts 28C, 28I. As illustrated in FIG. 3, a waste receiver 28E is located below the settling chamber 28H. The waste receiver 28E receives the fine particles separated in the settling chamber 28H.

Further, the duct 28C has a pre-coat feeder 28F, which is for mixing inactive powders with inflammable powders so that the mixture becomes flame-retardant.

The waste receiver 28E is connected to a sifter 28G through a conduit. The sifter 28G is connected to both the shot tank 20K and the inlet of the elevating screw conveyor 26C through separate conduits. The sifter 28G transfers usable shot contained in the shot coming from the shot tank 20K to the inlet of the elevating screw conveyor 26C, and transfers separated fine particles to the waste receiver 28E.

Figure 5:
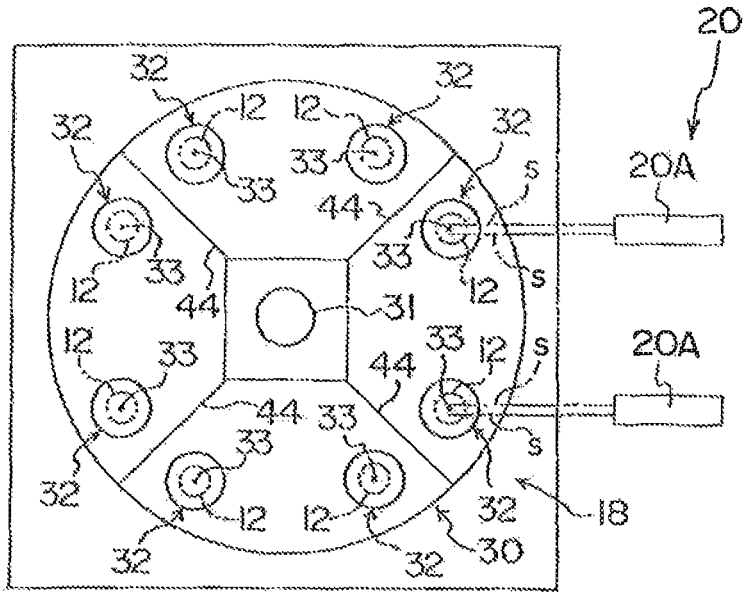
FIG. 5 is a schematic plan view of the work-table of the shot peening apparatus.
Figure 6:
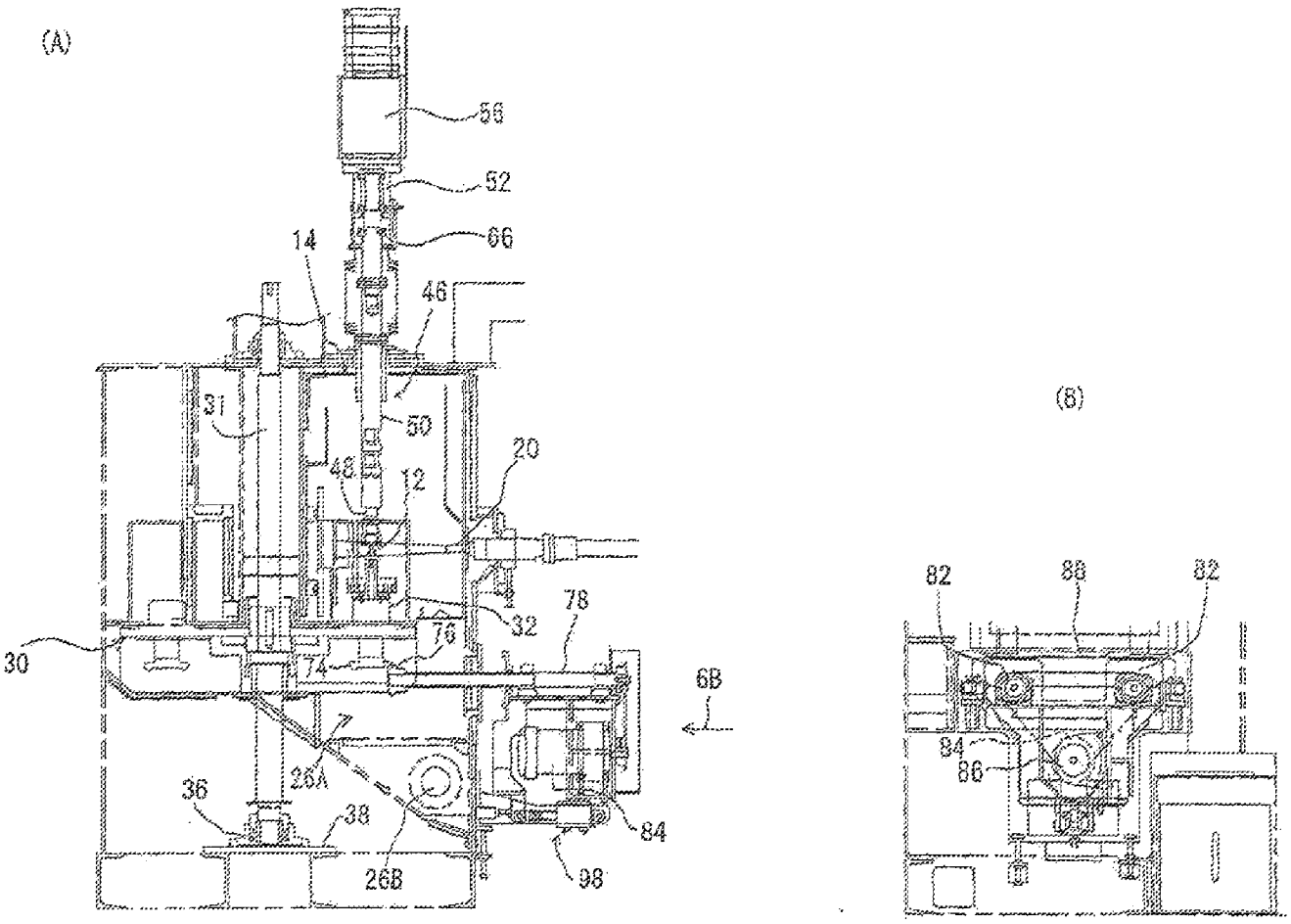
FIG. 6 shows the main part of the shot peening apparatus.

The details of the work-table 18 are discussed below. FIG. 5 is a schematic plan view of a work-table 18. FIG. 6 shows a longitudinal sectional view of the main part of the shot peening apparatus 10.

As illustrated in FIG. 5, the work-table 18 comprises a rotatable main table 30, and a plurality of rotatable satellite tables 32 (eight tables, in this embodiment) which are arranged in a circle around the main shaft 31 of the main table 30. Thus, the work-table 18 is configured as a so called multiple table. The main table 30 rotates about the main shaft 31, which runs vertically through the main table 30. The main table 30 is located in the place where both the projection area to be projected by the shot and the non-projection area are included. In FIG. 5, the boundaries of the projection area are indicated by two-dot chain lines S. The diameter of the satellite table 32 for placing a workpiece 12 is smaller than that of the main table 30. The satellite table 32 rotates about a driven shaft 33, which extends in parallel with the main shaft 31 of the main table 30. Further, the satellite tables 32 rotate around the main shaft 31 together with the main table 30.

As in FIG. 6A, the lower end of the main shaft 31 is mounted on a base member 38 via a shaft bearing 36. The upper end of the main shaft 31 is connected to a dividing assembly 42 (see FIG. 1) via a coupling member.

Since a variety of dividing assemblies are well known, detailed drawings of the dividing assembly 42 are omitted. In this embodiment, the dividing assembly 42 comprises a motor equipped with a brake for rotating the main table 30 in a stepwise manner, a positioning clamp for holding the main table at a specific rotational angle, and a positioning cylinder for operating the positioning clamp. By this, the dividing assembly 42 rotates the main table 30 about the main shaft 31 in a stepwise manner by the specific angle (90 degrees, in this embodiment) which is predetermined based on the arrangement of the satellite tables. When the main table 30 is rotated by the specific angle, the dividing assembly 42 temporarily stops the rotation of the main table 30 by means of the positioning clamp. Thus, the dividing assembly 42 rotates the main table 30 in a stepwise manner by the specific angle which is predetermined based on the arrangement of the satellite tables. Further, the dividing assembly 42 temporarily stops the rotation of the main table 30, so that at least one satellite table 32 (two tables, in this embodiment) is positioned in the projection area (see FIG. 5). The dividing assembly 42 can be constructed using, for example, a cam mechanism (e.g., INDEXMAN™, available from CKD.KK) and a motor equipped with a reducer.

With reference to FIG. 8, the dividing assembly 42 communicates with a controlling unit 64. The controlling unit 64 suspends the projection of shot from the projecting device 20 while the main table 30 is rotating, and resumes the projection of shot from the projecting device 20 when the rotation of the main table 30 is suspended.

As in FIG. 5, when the rotation of the main table 30 is suspended, the satellite tables are positioned at the following locations: the projection area to be projected upon by the shot (projection zone); a loading/unloading zone where the workpieces are transferred to and from the satellite tables 32 (the left-hand side in FIG. 5); and another zone which is included in the non-projection area. On the main table 30, a plurality of sections are formed by a plurality of walls 44 (four walls, in this embodiment) extending from the inside of the table to the circumference. In some embodiments, the walls 44 may have sealing members to seal the gaps between the walls 44 and the surrounding part. In some embodiments, to avoid a collision between the sealing members and the walls 44, the sealing members are contracted by the controlling unit while the main table 30 is rotating.

As in FIG. 6A, a holding assembly 46 (a holding device) is disposed above the projection area of the main table 30. The holding assembly 46 has a holding member 48 for holding down the workpiece 12 placed on the satellite table 32. The holding member 48 is fixed to the lower end of a holding shaft 50. The holding shaft 50 comprises a plurality of rods connected in series. The upper end of the holding shaft 50 is supported by a shaft bearing 52 which is fixed to a coupling member 58A disposed at the lower end of a rod 58 (see FIG. 8). The holding shaft 50, which is supported by the shaft bearing 52, is rotatable about the axis of thereof. However, the holding shaft 50 is not allowed to move up or down with respect to the rod 58 and the shaft bearing 52. Accordingly, the holding member 48 is not only rotatable about the axis of the holding shaft 50, but also rotatable along with the workpiece 12 and the satellite table 32 when the holding member 48 is holding down the workpiece 12. Since the lower part of the holding shaft 50 may be abraded by the shot, the lower part is configured to be exchangeable (i.e., comprising a plurality of rods connected in series), as in FIG. 6A.

As in FIG. 8, a part of a rod 58, and a piston 57 which is connected to the upper end of the rod 58, are disposed within a cylinder 56. The cylinder 56 is fixed to the ceiling of the cabinet 14 (see FIG. 1) by a linking member (not shown). The piston 57 and the rod 58 are moved up and down by means of fluid pressure (e.g., pneumatic pressure, in this embodiment) applied to the cylinder 56. Thus, when the rod 58 is moved up and down, the holding assembly 46, the shaft bearing 52, the holding shaft 50, and the holding member 48, are also moved up and down. In this embodiment, the piston 57 and the rod 58 are moved up down by the cylinder 56 fixed to the ceiling of the cabinet 14. Alternatively, the rod may be fixed to the ceiling of the cabinet so that the cylinder moves up and down. By this, the shaft bearing 52, the holding shaft 50, and the holding member 48 are also allowed to move up and down.

The cylinder 56 of the holding assembly 46 is connected to an air source 62 through an air-direction regulator (e.g., a solenoid valve) 60 which communicates with the controlling unit 64. The controlling unit 64 moves the piston 57 and the rod 58 up and down by controlling the air-direction regulator 60.

Accordingly, the holding member 48 is allowed to move down to contact the top of the workpiece 12. When the workpiece 12 is rotated about a vertical axis, the holding member 48 is rotated along with the workpiece 12.

As in FIG. 6A, the holding assembly 46 has a rotation-sensing means 66 which is mounted on the upper part of the holding shaft 50 and located slightly below the shaft bearing 52. The rotation-sensing means 66 detects the rotation of the holding shaft 50, i.e., the rotation of the holding member 48. As in FIG. 8, the rotation-sensing means 66 communicates with the controlling unit 64. When the rotation-sensing means 66 does not detect the rotation of the holding member 48 although the rotation of the main table 30 is suspended (i.e., the bolding member 48 is supposed to be rotating), the controlling unit 64 warns an operator that there is no rotation of the workpiece, via a warning means (not shown). The controlling unit 64 judges the rotational state of the main table 30 based on the information from the dividing assembly 42. The warning means for warning the operator is an alarm display or an audible alarm.

Figure 7:
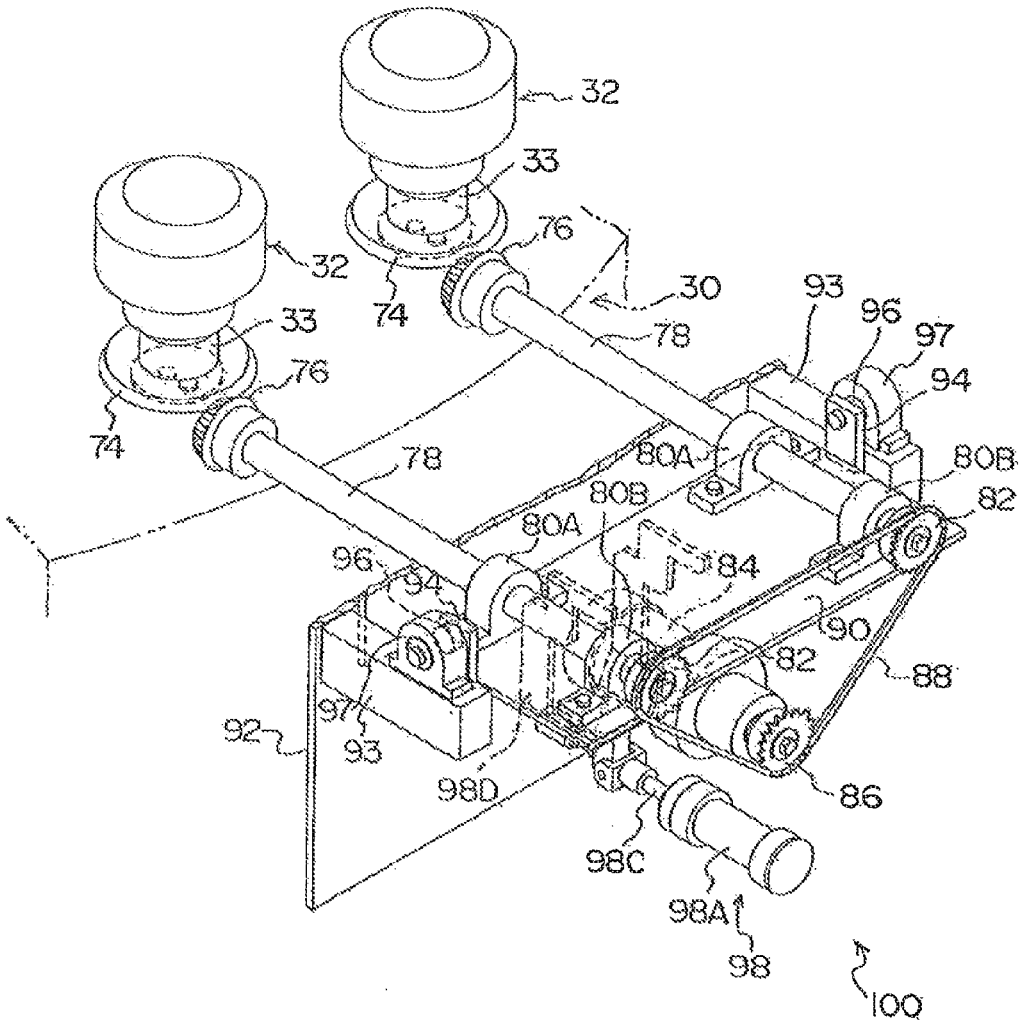
FIG. 7 is a perspective view of the driving mechanism for satellite tables of the shot peening apparatus according to the first embodiment.

As in FIG. 7, the driven shaft 33, extending downward from the satellite table 32, has a first mating member 74, which is concentrically fixed to the lower end of the driven shaft 33. The first mating member 74 has a bevel gear-like shape. Further, in the projection area, a second mating member 76, engageable with the first mating member 74, is disposed below the main table 30. The second mating member 76 also has a bevel gear-like shape. Thus, the first and second mating members 74, 76 have an engagement mechanism similar to a gear mechanism. The teeth of the first and second mating members 74, 76 are designed to be big enough to prevent disengagement when a certain amount of shot has entered between the teeth.

The second mating member 76, which is concentrically fixed to one end of a rod member 78, has a smaller diameter than the first mating member 74. However, the diameter of the second mating member 76 can be the same as that of the first mating member 74 (i.e., miter gears having the same number of teeth can be used). The rod member 78, which is rotatably supported by the shaft bearings 80A, 80B, has a chain wheel 82 fixed to the end opposed to the second mating member 76. A driving motor 84, fixed to the lower surface of a base plate 90 by a fixing means, is located below a pair of rod members 78 and closer to the chain wheel 82 (see FIG. 6B) than the second mating member 76. The driving motor 84 has a lower chain wheel 86 concentrically fixed to the drive shaft thereof. The lower chain wheel 86 is located just below the chain wheel 82. The lower chain wheel 86 is coupled to the chain wheel 82 by an endless chain 88. Accordingly, the driving motor 84 rotates the second mating members 76 by rotating the pair of rod members 78 through the lower chain wheel 86, the chain 88, and the chain wheel 82. Further, the second mating members 76 rotate the first mating members 74, when these mating members are engaged.

The second mating members 76 are combined with a meshing assembly 100 for conducting the engagement and disengagement of the first and second mating members 74, 76. The meshing assembly 100, which includes the rod member 78, engages the second mating members 76 with the first mating members 74 when the rotation of the main table 30 is suspended, and disengages the second mating members 76 from the first mating members 74 before starting the rotation of the main table 30. The meshing assembly 100 will be discussed below in detail.

The shaft bearings 80A, 80B for supporting a pair of the rod members 78 are fixed to a base plate 90. The base plate 90 has a pair of brackets 94 which are arranged so that the pair of shaft bearings 80A is located between them. Each bracket 94 has a pin 96, which is rotatably supported by a pin-support member 97. The pair of pins 96 is arranged on the same imaginary horizontal axis which is perpendicular to the rotational axes of the rod members 78. The pin-support member 97 is fixed to a longitudinal base plate 92 via a connecting part 93.

As in FIGS. 6A and 7, an air cylinder 98 (a cylinder mechanism) is disposed below the driving motor 84. The axis of the air cylinder 98, which extends in the same direction as the axes of the rod members 78, is parallel to the axis of the driving motor 84. As illustrated in FIG. 8, the air cylinder 98 includes, in a cylinder 98A, a piston 98B, which is moved along the axis of cylinder 98A by pneumatic pressure (or fluidal pressure) supplied to the cylinder. The piston 98B is connected to the proximal end of a rod 98C of the cylinder 98. The distal end of the rod 98C is rotatably connected to one end of an arm 98D. Another end of the arm 98D is fixed to the lower surface of the base plate 90 at the location between the second mating members 76 and the imaginary horizontal axis of the pins 96.

The air cylinder 98 of a meshing assembly 100 is connected to an air source 104 via an air-direction regulator 102 (e.g., a solenoid valve) which communicates with the controlling unit 64. The controlling unit 64 controls the expansion and contraction of the air cylinder 98 by controlling the air-direction regulator 102 based on the information from the dividing assembly 42. In this embodiment, the meshing assembly 100 disengages the second mating member 76 from the first mating member 74 by actuating the air cylinder 98 so that the rod member 78, which has the second mating member 76, rotates about the pin 96 in a direction (a direction indicated by the arrow A as in FIG. 8) to be away from the first mating member 74 (see FIG. 9B).

The operation and the effect of the shot peening apparatus 10 of the above embodiment is discussed below.

As illustrated in FIG. 5, the rotatable main table 30 is located in the place where both the projection area to be projected upon by the shot from the projecting device 20 and the non-projection area other than the projection area are included. A plurality of rotatable satellite tables 32 for placing workpieces 12 are mounted on the main table 30. Each satellite table 32 has a driven shaft 33 which is in parallel with the main shaft 33 of the main table 30. Further, the shot is projected from the projecting device against the workpiece 12 placed on the satellite table 32 for treating the surface of the workpiece 12.

As illustrated in FIG. 6A, the holding assembly 46 is disposed above the main table 30 in the projection area. The holding member 48 included in the holding assembly 46 holds down the workpiece 12 placed on the satellite table 32. The holding member 48 is configured to be rotatable along with the workpiece 12. By this, the workpiece 12 is stably held on the satellite table 32 when it is subjected to a shot-treatment. Further, even when one or more workpieces 12 are subjected to the shot-treatment, other workpieces 12 located in the non-projection area (loading and unloading zone) can be loaded to and unloaded from the satellite table 32 (the left-hand side of FIG. 5).

When the holding member 48 as in FIG. 6A rotates along with the workpiece 12, the rotation-sensing means 66 detects the rotation of the holding member 48. When the rotation-sensing means 66 does not detect the rotation of the holding member 48 although the rotation of the main table 30 is suspended (i.e., the holding member 48 is supposed to be rotating), the controlling unit 64 as in FIG. 8 warns an operator that there is no rotation of the workpiece 12 through a warning means (not shown). The controlling unit 64 judges the rotational state of the main table 30 based on the information from the dividing assembly 42. The warning means gives a warning to the operator with an alarm display or an audible alarm. Thus, the shot peening apparatus 10 can judge whether a uniform shot peening effect on the workpieces 12 is achieved.

The dividing assembly 42 rotates the main table 30 about the main shaft 31 in a stepwise manner by a specific angle (90 degrees in this embodiment) which is predetermined based on the arrangement of the satellite tables 32. When the rotation of the main table 30 is suspended, at least one satellite table 32 (two satellite tables, in this embodiment) is positioned within the projection area. Further, the controlling unit 64 suspends the projection of the shot from the projecting device 20 while the main table 30 is being rotated by the dividing assembly 42, and resumes the projection of the shot when the rotation of the main table 30 is suspended. By this, any leakage of the shot from the apparatus is reduced. Further, a uniform shot peening effect on workpieces 12 is achieved.

In this embodiment, the satellite table 32 has the first mating member 74, which is disposed on the driven shaft 33 extending downwardly from the satellite table 32. The second mating member 76, which is located below the main table 30 in the projection area, is capable of engaging with the first mating member 74. The second mating member 76 transmits a rotational driving force to the first mating member 74, when the second mating member 76 engages with the first mating member 74. The meshing assembly 100 engages the second mating member 76 with the first mating member 74 when the rotation of the main table 30 is suspended. Further, the meshing assembly 100 disengages the second mating member 76 from the first mating member 74 before starting the rotation of the main table 30. By this, when the rotation of the main table 30 is suspended, the workpiece 12 is constantly rotated. As a result, a uniform shot peening on the entire surface of the workpiece 12 is achieved. Further, the main table 30 is smoothly rotated when the rotation of the table is started again.

The second mating member 76 is disposed at one end of the rod member 78. The air cylinder 98 of the meshing assembly 100 drives the rod member 78 in the direction of disengaging the second mating member 76 from the first mating member 74. Namely, before starting the rotation of the main table 30 by the dividing assembly 42, the controlling unit 64 contracts the air cylinder 98 by controlling the air-direction regulator 102 based on the information from the dividing assembly 42. When the air cylinder 98 is contracted (in the direction indicated by the arrow B as in FIG. 8), the rod member 78 is downwardly swung (in the direction indicated by the arrow A as in FIG. 8) along with the arm 98D, the base plate 90, and the shaft bearings 80A. At the same time, the pair of brackets 94 fixed to the base plate 90 rotates about the axis of pins 96. As a result, the second mating member 76, which is fixed to the end of the rod member 78, is disengaged from the first mating member 74 (see FIGS. 9A and 9B).

When the rotation of the main table 30 is suspended, the controlling unit 64 expands the air cylinder 98 by controlling the air-direction regulator 102 based on the information from the dividing assembly 42. When the air cylinder 98 expands (the opposite direction to the arrow B), the rod member 78 is upwardly swung (the opposite direction to the arrow A) along with the arm 98D, the base plate 90, and the shaft bearings 80A. At the same time, the pair of brackets 94 fixed to the base plate 90 rotates about the axis of pins 96. As a result, the second mating member 76, which is fixed to the end of the rod member 78, is engaged with the first mating member 74 (see FIGS. 9A and 9B).

By this, the engagement and disengagement of the first and second mating members 74, 76 are conducted with a simple mechanism. Further, since the rotation of the main table 30 and the satellite tables 32 are not interrupted, a uniform shot peening effect on the workpieces 12 is achieved.

As discussed above, the shot-treatment apparatus 10 of this embodiment allows a high throughput of the workpieces 12 with the least possible idle time while achieving a uniform shot peening effect on the workpieces 12.

Further, as illustrated in FIGS. 7 and 8, the driving motor 84, which is located below the pair of the rod members 78, rotates the second mating member 76 via the chain wheel 86, the chain 88, the chain wheel 82, and the rod member 78. By this, the size of the shot-treatment apparatus is reduced. Further, the air cylinder 98 is located below the driving motor 84 so that the axis of the air cylinder 98 becomes in parallel with the rotational axis of the motor 84. By this, the size of the shot-treatment apparatus is reduced further.

Figure 10:
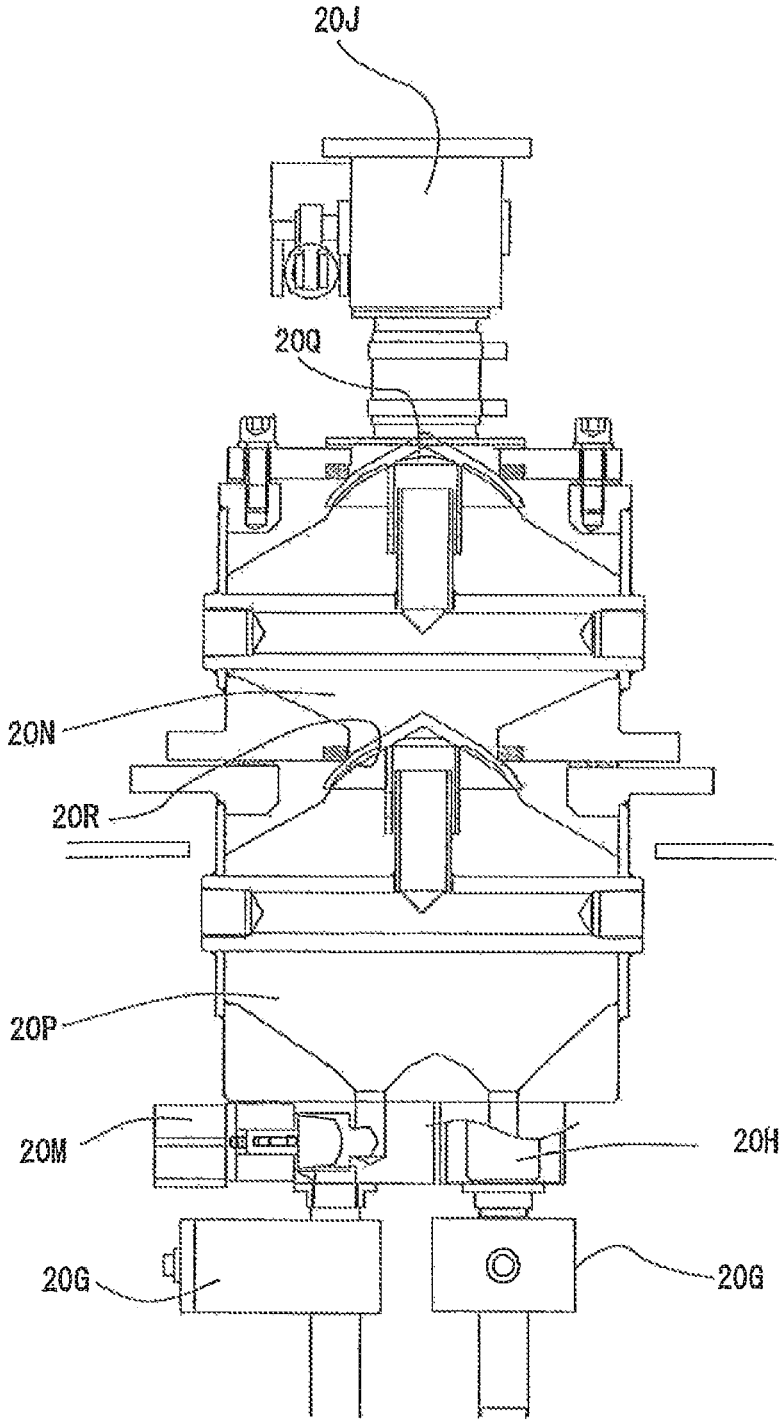
FIG. 10 is a partially enlarged view of an example of the modified pressure tank of the shot peening apparatus and associated facilities thereof, according to the first embodiment.

In place of the pressure tank 22 and associated facilities thereof as in FIG. 4, the pressure tank illustrated in FIG. 10 can be used. Below, the pressure tank as in FIG. 10 is briefly described. In FIG. 10, the elements which are the same as those in FIG. 4 are indicated by the same numerals, and a detailed description is omitted.

As illustrated in FIG. 10, an upper pressure tank 20N and lower pressure tank 20P are connected in series under a constant feeder 20J. The lower pressure tank 20P is connected to a cut-gate 20H. The constant feeder 20J is connected to the upper pressure tank 20N via an upper poppet valve 20Q. The upper pressure tank 20N is connected to the lower pressure tank 20P via a lower poppet valve 20R. The upper poppet valve 20Q is activated by the pressure from the upper pressure tank 20N, and the lower poppet valve 20R is activated by the pressure from the lower pressure tank 20P.

For projecting shot against a workpiece, the lower pressure tank 20P is pressurized by closing the lower poppet valve 20R, and then the cut-gate 20H below the lower pressure tank 20P and a flow regulator 20G are opened to transfer the shot to a mixing valve 20E (see FIG. 1). For supplying the shot to the upper pressure tank 20N while projecting the shot, the upper pressure tank 20N is depressurized, and then the upper poppet valve 20Q is opened to transfer a desired amount of shot from a shot tank 20K (see FIG. 1) to the upper pressure tank 20N via the constant feeder 20J.

When the upper pressure tank 20N is filled up with the shot, the constant feeder 20J is closed to pressurize the upper pressure tank 20N. Then, the upper poppet valve 20Q is closed by the pressure from the upper pressure tank 20N. Then, the lower poppet valve 20R is opened by the pressure difference between the upper pressure tank 20N and the lower pressure tank 20P, which is slightly depressurized owing to the projection of the shot. As a result, the shot is transferred to the lower pressure tank 20P from the upper pressure tank 20N. After the transferring operation is completed, the pressurization of the upper pressure tank 20N is terminated, to close the lower poppet valve 20R.

By this, continuous projection of the shot is allowed.

Second Embodiment

The shot peening apparatus 110 according to the second embodiment of the invention is described below with reference to FIG. 11. It shows a schematic plan view of the main part of the shot peening apparatus 110 of the second embodiment. The apparatus of this embodiment has the same elements as those of the first embodiment, except for the elements described below. Thus, the elements which are the same as those of the first embodiment are indicated by the same numerals, and a detailed description is omitted.

Figure 11:
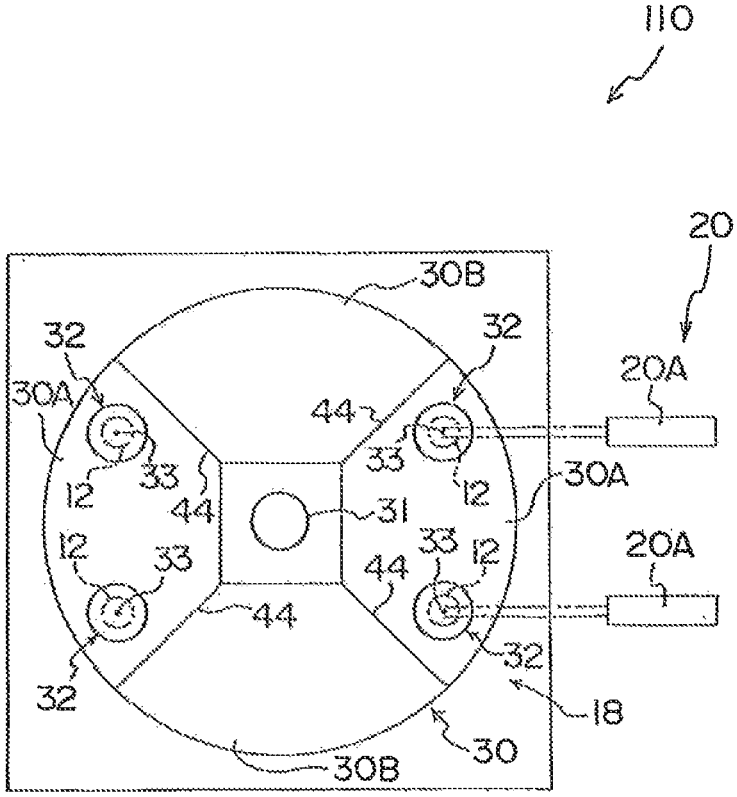
FIG. 11 is a schematic plan view of a work-table of the shot peening apparatus, according to the second embodiment of the invention.

As in FIG. 11, on a main table 30, a plurality of sections (30A, 30B) are formed by a plurality of walls 44 (four walls, in this embodiment) extending in directions from the inside of the table to the circumference. The plurality of sections (30A, 30B) are classified into a first section 30A, which has at least one satellite table 32, and a second section 30B, which does not have the satellite table 32. The first section 30A and the second section 30B are arranged alternately.

The invention of the second embodiment has the same effect as that of the first embodiment. Further, any leakage of the shot from the apparatus is effectively prevented.

With regard to the embodiments disclosed herein, various changes and modifications can be made. For example, the holding member 48 has the rotation-sensing means 66. Such a configuration is preferable to detect whether a uniform shot peening effect on the workpieces 12 is achieved. However, the rotation-sensing means can be omitted.

The dividing assembly 42 in FIG. 1 rotates the main table 30 about the main shaft 31 in a stepwise manner by a specific angle (90 degrees in this embodiment), which is predetermined based on the arrangement of the satellite tables 32. Alternatively, a sensor for detecting the satellite table 32 can be used for rotating the main table in a stepwise manner about the main shaft 31 by the specific and predetermined angle based on the positions of the satellite tables 32.

The meshing assembly 100 as in FIG. 7 includes the rod member 78. The meshing assembly 100 engages the second mating members 76 with the first mating members 74 when the rotation of the main table 30 is suspended, and disengages the second mating members 76 from the first mating members 74 before starting the rotation of the main table 30. Such a configuration is preferable for stably rotating the satellite tables 32 and for rotating the main table 30 without any interruption. However, the meshing assembly 100 can be replaced with first and second rubber rollers, which function as the first and second mating members.

In the above embodiments, the meshing assembly 100 includes the air cylinder 98, which drives the rod member 78 in the direction of disengaging the second mating member 76 from the first mating member 74. Alternatively, the meshing assembly can be configured using a solenoid in place of the air cylinder 98, so that the solenoid drives the rod member in the direction of disengaging the second mating member from the first mating member. In another embodiment, the air cylinder 98 can be replaced by a hydraulic cylinder.

The first mating member 74, which is fixed to the lower end of the driven shaft 33 in the above embodiments, can be integrally formed at the lower end of the driven shaft. Further, the second mating member 76, which is fixed to one end of the rod member 78 in the above embodiments, can be integrally formed at one end of the rod member.

In the above embodiments, the driving motor 84 for rotating the second mating member 76 is located below the pair of the rod members 78. Such a configuration is preferable for reducing the size of the apparatus. However, the driving motor for rotating the second mating member can be located in another place, such as on the imaginary extension of the rod member. Alternatively, the driving motor can be a motor equipped with a reducer having a hollow shaft, wherein the hollow shaft of the motor equipped with the reducer is connected to the chain wheel 82.

In the above embodiments, the air cylinder 98 is disposed below the driving motor 84, wherein the axis of the air cylinder 98 is in parallel with the rotational axis of the motor 84. Such a configuration is preferable for reducing the size of the apparatus. However, the cylinder mechanism can be located in another place, such as on the imaginary extension of the rotational axis of the motor 84.

Although the shot-treatment apparatus discussed in the above embodiments is the shot peening apparatus 10, 110 having the projecting device 20, the shot-treatment apparatus can be a shot blasting apparatus having the projecting device 20. Alternatively, the shot peening apparatus 10, 110 can be used as a shot peening-curn-shot blasting apparatus.

The embodiments and the modifications thereof discussed above can be combined, if desired.

LIST OF REFERENCE SIGNS

10 shot-peening apparatus (shot-treatment apparatus)
12 workpiece
20 projecting device
30 main table
30A first section
30B second section
32 satellite table
42 dividing assembly
44 wall
46 holding assembly
48 holding member
64 controlling unit
66 rotation-sensing means
74 first mating member
76 second mating member
78 rod member
82 chain wheel (means for transmitting the driving force)
84 driving motor
86 chain wheel (means for transmitting the driving force)
88 chain
98 air cylinder (cylinder mechanism)
100 meshing assembly
110 shot-peening apparatus (shot-treatment apparatus)

The invention claimed is:

1. A shot treatment apparatus comprising:

a projecting device for projecting shot with compressed air through a nozzle against a workpiece;

a rotatable main table located in a place where both a projection area to be projected upon by the shot from the projecting device and a non-projection area other than the projection area are included;

a plurality of rotatable satellite tables mounted on the main table, wherein each of the satellite tables for placing workpieces has a driven shaft in parallel with a main shaft of the main table;

a plurality of first mating members disposed on the individual driven shafts extending downward from each of the satellite tables;

at least one second mating member located below the main table in the projection area, wherein the second mating member is engageable with any of the first mating members to transmit a rotational driving force to the first mating member; and a meshing assembly for engaging the second mating member with the first mating member when the rotation of the main table is suspended, and for disengaging the second mating member from the first mating member before starting the rotation of the main table;

a holding assembly disposed above the projection area of the main table, wherein the holding assembly holds down the workpiece placed on the satellite table with a holding member which is configured to be rotatable along with the workpiece.

2. The shot-treatment apparatus of claim 1 further comprises a rotation-sensing device for detecting the rotation of the holding member.

3. The shot-treatment apparatus of claim 1 or 2 further comprising:

a driving assembly which rotates the main table about the main shaft in a stepwise manner by a specific angle which is predetermined based on the arrangement of the satellite tables on the main table, so that at least one satellite table is positioned within the projection area when the rotation of the main table is suspended; and a controlling unit which suspends the projection of the shot from the projecting device while the main table is being rotated by the dividing assembly, and resumes the projection of the shot when the rotation of the main table is suspended.

4. The shot-treatment apparatus of claim 1, wherein the meshing assembly further comprises:

a rod member having the second mating member at one end thereof;

and a cylinder mechanism for driving the rod member in the direction of disengaging the second mating member from the first mating member.

5. The shot-treatment apparatus of claim 4 further comprising a driving motor disposed below the rod member for rotating the second mating member together with the rod member, wherein the rod member is rotated by the motor through a device for transmitting the driving force.

6. The shot-treatment apparatus of claim 5, wherein the cylinder mechanism is disposed below the driving motor so that the axis of the cylinder mechanism is in parallel with the rotational axis of the motor.

7. The shot-treatment apparatus of claim 6 further comprising at least one first section and at least one second section alternately formed on the main table by a plurality of walls extending from the inside of the table to the circumference thereof, wherein the first section is provided with the satellite table, and the second section has no satellite table.

8. The shot-treatment apparatus of claim 1 further comprising at least one first section and at least one second section alternately formed on the main table by a plurality of walls extending from the inside of the table to the circumference thereof, wherein the first section is provided with the satellite table, and the second section has no satellite table.

* * * * *